US007735205B2

(12) United States Patent
Sälinger

(10) Patent No.: US 7,735,205 B2
(45) Date of Patent: Jun. 15, 2010

(54) EXPANDED METAL MACHINE AND METHOD OF PRODUCING EXPANDED METAL

(75) Inventor: Johannes Sälinger, Wunstorf (DE)

(73) Assignee: Sorst Streckmetall GmbH, Hannover (DE)

( * ) Notice: Subject to any disclaimer, the term of this patent is extended or adjusted under 35 U.S.C. 154(b) by 515 days.

(21) Appl. No.: 11/716,039

(22) Filed: Mar. 9, 2007

(65) Prior Publication Data

US 2007/0240293 A1 Oct. 18, 2007

Related U.S. Application Data

(63) Continuation of application No. PCT/DE2005/001565, filed on Sep. 7, 2005.

(30) Foreign Application Priority Data

Sep. 9, 2004 (DE) ..... 10 2004 043 583

(51) Int. Cl.
*B21D 31/04* (2006.01)
*B26D 1/00* (2006.01)

(52) U.S. Cl. ..... 29/6.1; 29/6.2; 29/896.6; 72/186; 72/187; 83/695

(58) Field of Classification Search ..... 29/6.1, 29/6.2, 896.6; 72/186, 187; 83/578, 695
See application file for complete search history.

(56) References Cited

U.S. PATENT DOCUMENTS 1,448,109 A * 3/1923 Dean et al. ..... 29/6.2
1,674,613 A * 6/1928 Arey ..... 29/6.1
3,218,689 A 11/1965 Mumma
3,268,974 A * 8/1966 Felsenthal ..... 29/6.2
3,308,597 A 3/1967 Simonton
3,677,055 A 7/1972 Longhi
3,813,743 A * 6/1974 Harrell et al. ..... 29/6.2
3,893,214 A * 7/1975 Parkinson ..... 29/6.2

(Continued)

FOREIGN PATENT DOCUMENTS

DE 34 25 193 A1 1/1985

(Continued)

OTHER PUBLICATIONS

International Search Report dated Jan. 17, 2006 in PCT/DE2005/001565, filed Sep. 7, 2005 (3 pages).

*Primary Examiner*—Essama Omgba
(74) *Attorney, Agent, or Firm*—Shlesinger, Arkwright & Garvey LLP

(57) ABSTRACT

Expanded metal machine includes a stationary knife and an adjustable knife which is adjustable in a vertical direction and a transverse direction. The adjustable knife includes a cutting edge with spaced-apart cutting projections in the transverse direction. A transport device for transporting a flat material in a direction of transport between the knives is provided. A cam is provided and configured for performing a periodic vertical motion. There is a transverse adjustment device configured for adjusting the transverse motion of the adjustable knife in a manner synchronized with the traveling motion. Likewise, there is an eccentric drive provided for the cam, and that is configured for guiding the cam in a circulatory motion which runs in a plane determined (e.g., bounded) by the vertical direction and the transverse direction.

18 Claims, 2 Drawing Sheets

U.S. PATENT DOCUMENTS

| | | | | |
|---|---|---|---|---|
| 3,987,521 | A | 10/1976 | Parkinson et al. | |
| 4,502,315 | A | 3/1985 | Dubrovsky et al. | |
| 5,095,597 | A * | 3/1992 | Alhamad et al. | 29/6.1 |
| 5,896,635 | A * | 4/1999 | Marlow et al. | 29/6.1 |
| 6,145,363 | A | 11/2000 | Farina et al. | |
| 6,202,271 | B1 * | 3/2001 | Goda et al. | 29/6.2 |
| 6,526,637 | B1 * | 3/2003 | Geissler | 29/6.1 |
| 6,629,016 | B1 * | 9/2003 | Smith | 700/145 |
| 7,415,860 | B2 * | 8/2008 | Yamauchi | 72/385 |
| 2003/0187539 | A1 | 10/2003 | Smith | |
| 2008/0016931 | A1 * | 1/2008 | Salinger | 72/186 |

FOREIGN PATENT DOCUMENTS

| | | |
|---|---|---|
| DE | 197 28 913 C1 | 11/1997 |

* cited by examiner

14

EXPANDED METAL MACHINE AND METHOD OF PRODUCING EXPANDED METAL

CROSS-REFERENCE TO RELATED APPLICATIONS

This application is a continuation of application no. PCT/DE2005/001565, filed Sep. 7, 2005, which claims the priority of German application no. 10 2004 043 583.9, filed Sep. 9 2004, and each of which is incorporated herein by reference.

FIELD OF THE INVENTION

The invention relates to an expanded metal machine. More particularly, the invention relates to an expanded metal machine, and a method for producing expanded metal.

BACKGROUND OF THE INVENTION

Expanded metals are materials which have openings in their surface and are produced from a flat material, especially metal plates or metal strips, by making offset cuts without loss of material and concurrently undergoing stretch or expansion forming.

In this connection, the successive cycles (for a vertical alignment of the machine) are as follows:

the flat starting material is guided between knives;

the starting material is cut by the moving knife while being subjected to stretch forming;

the knife is again withdrawn vertically and then adjusted laterally by a half mesh-length;

the knife is again adjusted vertically to cut into the starting material, thereby making first meshes, and the knife is again withdrawn vertically and adjusted laterally into the starting position; and whereupon, the starting material can again be guided back.

The expanded metal can subsequently be processed further, e.g. rolled flat.

The moving knife is attached to a tool holder, which is laterally adjusted in a synchronized manner with the traveling motion by means of a transverse adjusting device. A cam again adjusts the tool holder in the vertical direction. In this connection, the cam is guided in a sliding guide or roller guide in a conventional manner. Although a sliding guide is first of all easier to construct, it requires good lubrication and does not permit any prestress. In a roller guide, prestress can be provided to eliminate the play that would otherwise arise. However, given that the rollers are only rotated around a small portion of their circumference because of the small stroke (e.g. 3 mm) and the back and forth motion of the cam, they quickly become out-of-round and lock.

U.S. Pat. No. 3,308,597 discloses an expanded metal machine, and a method, in which the respectively movable and adjustable knife is arranged above and the stationary knife is arranged below. The flat sheet-metal material is unrolled from a feed roller, guided between the knives, guided downwards from there over another roller, and stretched and then rolled up on another roller.

OBJECTS AND SUMMARY OF THE INVENTION

The object of the invention is to provide an expanded metal machine and a method of producing expanded metal that ensures reliable, precise production of expanded metal even at high numbers of strokes or frequencies while keeping wear low.

This object is accomplished by an expanded metal machine and a method of making expanded metal as set forth herein. The claims describe additional embodiments. The terms "vertical, horizontal" refer to the usual alignment of the machine; in principal, corresponding respective inclined or laterally tipped alignments of the machine are also advantageously possible.

According to the invention, the cam thus executes a circulatory motion instead of the conventional, linear reciprocating or traveling motion. For this purpose, eccentric shafts are provided with roller bearings, thereby requiring only a relatively small extra cost. According to the invention, in this manner the axial bearings of the eccentric shafts can execute complete revolutions by tumbling motion or circulatory motion of the cam, so that the problems of non-uniform wear that arise for conventional bearings can be eliminated. A substantial increase in service life and a reliable guidance can thus be achieved at relatively little extra cost.

Advantageously, that portion of the traveling motion in which the metal is cut is executed during the circulatory motion at a first, slower speed in a manner that saves material, and then the idle movement, in which no cutting or stretching action occurs, is executed at a second, higher speed, so that very high cycle rates can be achieved. For this purpose, the input shaft is driven at a variable rotational speed, an action which can be accomplished using a suitable gear, e.g. with out-of-round wheels or with a computer-controlled speed control.

According to the invention, there are provided at least two, preferably three, eccentric shafts, which are synchronized to one another by a tensioning belt, which can be appropriately prestressed. If three eccentric shafts are provided, camberings of the cam can be absorbed.

Relative terms such as left, right, up, and down, are for convenience only and are not intended to be limiting.

An embodiment of the invention will be explained in more detail on the basis of the enclosed drawings.

DETAILED DESCRIPTION OF THE INVENTION

Figure 1:
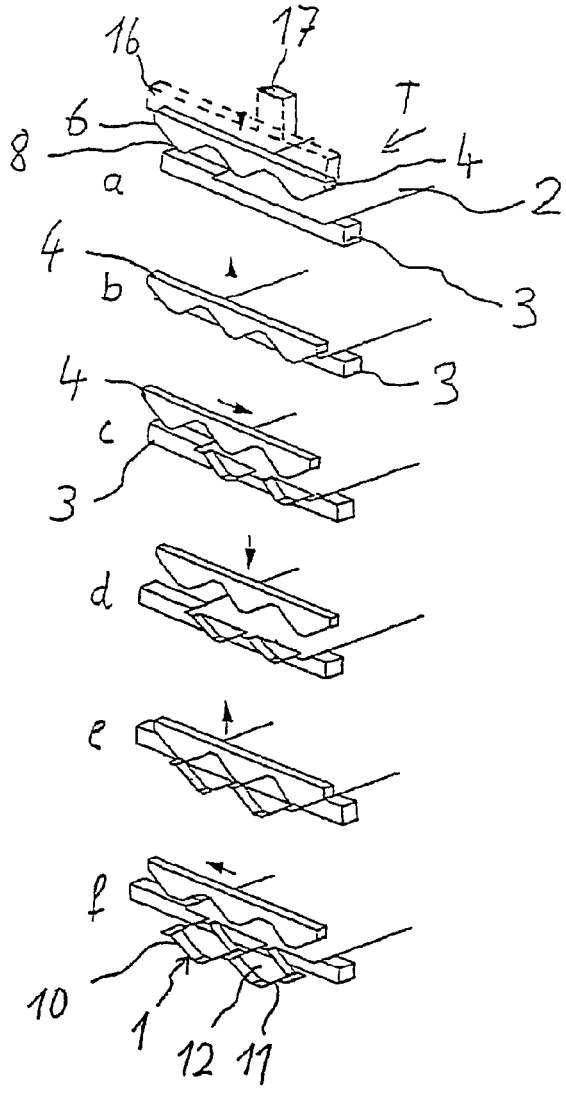
FIGS. 1*a* to *f* show the cutting action for producing expanded metal according to the invention.

To produce an expanded metal 1, a flat, metallic starting material, such as a steel strip 2 of coil, is processed by making offset cuts without loss of material, and by performing stretch or expansion forming at the same time. In this connection, the metal strip 2 is guided between a lower knife 3 and an upper knife 4. In the embodiment depicted in FIGS. 1*a* to *f*, the upper knife 4 is moved and the lower knife 3 is kept fixed. According to the invention, the reverse kinematic configuration is also basically advantageously possible. The moving knife 4 includes a zigzag cutting edge 6 having a plurality of cutting projections 8, which are advantageously uniformly spaced in the transverse direction. The non-moving lower knife 3 is configured planar. To produce expanded metal 1, the metal strip 2 is first guided between the knives 3 and 4 in the direction of transport T as per FIG. 1*a*, and the upper knife 4 is then guided downwards, so that the cutting projections 8 cut into the metal strip 2 as per FIG. 1*b* and in this connection the regions of the metal strip 2 protruding over the lower knife 3 stretch downward. The upper knife 6 is then adjusted upwards as per FIG. 1*b* and then adjusted laterally by a half mesh-distance as per FIG. 1*c*. The upper knife 4 is then guided downwards as per FIG. 1*d* and again cuts into the metal strip 2 in positions that are offset by a half-mesh relative to the first cuts and thereby stretches downwards the webs 10 of the expanded metal 1 that are formed so that rhomboidal meshes 11 having holes 12 surrounded by the webs 10 are formed. Subsequently, the upper knife 6 is again driven upwards as per FIG. 1*e* and then in a lateral direction as per FIG. 1*f* back to the starting position corresponding to FIG. 1*a*.

Figure 2:
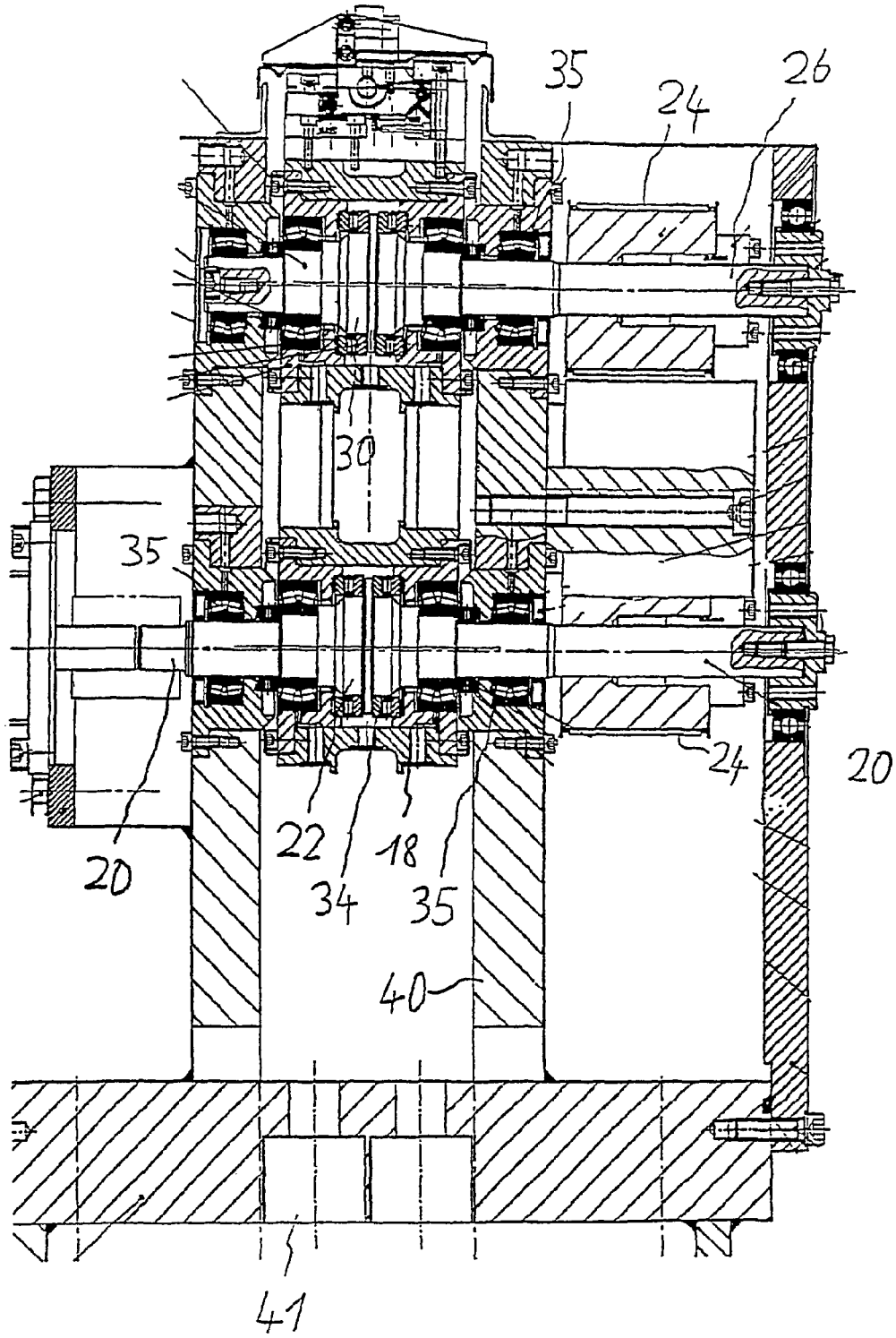
FIG. 2 shows a longitudinal or axial section through the drive of an expanded metal machine according to the invention.

FIG. 2 shows the drive of an expanded metal machine 14 according to the invention in which (differently than in FIG. 1) the lower knife moves and the upper knife is held stationary. The lubrication and oil seal of the moving knife is thereby improved. The moving knife is accommodated in a tool holder 16, which is indicated by dashed lines in FIG. 1, and which is adjusted in the transverse direction by a schematically illustrated transverse adjusting device 17 and in the vertical direction by a cam 18.

In the device 14 according to the invention, the cam 18 is thus adjusted not only in the vertical direction, but is guided in an eccentric motion or tumbling motion or circulatory motion perpendicular to the direction of transport T of the metal strip 2; that is, in a plane determine (e.g., bounded) by the vertical direction and the transverse direction. For this purpose, a first eccentric 22 is attached to an input shaft 20 driven by an unillustrated motor. The input shaft 20 furthermore uses a belt 24 to drive two other shafts 26, 28 to each of which an eccentric 30 is respectively attached. The cam 18 is mounted on the eccentrics 22, 30 by eccentric bearings 34 configured as roller bearings and is thus guided in a tumbling motion or circulatory motion when the input shaft 20 rotates. The shafts 20, 26, and 28 are furthermore mounted in a housing 40 of the machine 14 by axial bearings 35 configured as roller bearings. The eccentric bearings 34 and axial bearings 35 undergo complete rotational motions according to the invention. There is thus an eccentric drive provided for the cam 18, and that is configured for guiding the cam 18 in a circulatory motion which runs in the plane determined by the vertical direction and the transverse direction, the aim of the invention is to allow the reliable, precise production of expanded gratings even at high numbers of strokes or frequencies while keeping wear low. For this purpose, an eccentric drive including input shaft 20, eccentric 22, 24, shaft 26, shaft 28, eccentric 30, eccentric bearings 34, and a tension roller 36 drives the cam 18, thereby guiding the cam 18 in a circulatory motion which runs in a plane that is determined by the vertical direction and the transverse direction. Tension roller 36 is described further below.

The tool holder 16 is advantageously accommodated slidingly on the cam 18 in the transverse direction and executes a purely vertical traveling motion. For this purpose, it can be guided in a vertical guide, for example, to suppress a tumbling motion; for the transverse adjustment in this connection, the vertical guide can be adjusted by the half mesh-length in the transverse direction.

The cam 18 is advantageously prestressed downwards by an unillustrated spring, which is fastened on the cam 18 in screw holes 41.

Figure 3:
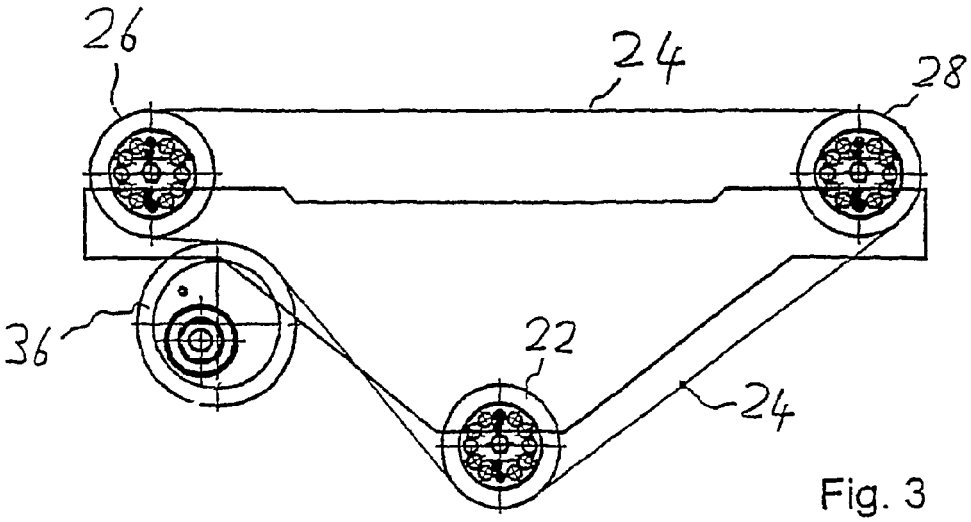
FIG. 3 shows a transverse or radial cut through the device of FIG. 2.

As per FIG. 3, a tension roller 36 can be provided to tension the belt 24.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. An expanded metal machine, comprising:

a) a stationary knife and an adjustable knife which is adjustable in a vertical direction and a transverse direction, the adjustable knife including a cutting edge with spaced-apart cutting projections in the transverse direction, the transverse direction extending transversely to the vertical direction, and the vertical direction and the transverse direction determining a plane;

b) a transport device for transporting a flat material in a direction of transport between the knives;

c) a cam configured for performing a periodic vertical motion;

d) a transverse adjustment device configured for adjusting the transverse motion of the adjustable knife in the transverse direction and in a manner synchronized with a traveling motion; and e) an eccentric drive being provided for the cam, thereby guiding the cam in a circulatory motion which runs in the plane determined by the vertical direction and the transverse direction.

2. The expanded metal machine according to claim 1, wherein:

a) the cam is driven by at least two synchronized eccentrics.

3. The expanded machine according to claim 2, wherein:

a) an axial bearing of one of the at least two eccentrics is a roller bearing.

4. The expanded expanded machine according to claim 2, wherein:

a) the at least two eccentrics include at least one shaft, and the at least one shaft is prestressed.

5. The expanded metal machine according to claim 4, wherein:

a) the at least one shaft includes shafts, and the shafts are coupled by a belt tensioned by a tension roller.

6. The expanded metal machine according to claim 4, wherein:

a) the at least one shaft includes shafts, and the shafts are drivable at a variable rotational speed.

7. The expanded metal machine according to claim 6, wherein:

a) a partial motion of the cam, in which the moving knife cuts into the flat material and the material stretches, is configured for causing the cutting to be executed more slowly and an immediately subsequent partial motion to be executed faster.

8. The expanded metal machine according to claim 1, wherein:

a) the cam is prestressed in a direction opposite a working motion.

9. The expanded metal machine according to 1, wherein:

a) the adjustable knife is arranged below and the stationary knife is arranged above.

10. The expanded metal machine according to claim 1, wherein:

a) the adjustable knife is accommodated in a tool holder, which is adjusted in the transverse direction by the transverse adjusting device, and which is adjusted in the vertical direction by the cam; and b) the tool holder is accommodated adjustably on the cam in the transverse direction and executes a purely vertical traveling motion.

11. The expanded metal machine according to claim 10, wherein:

a) the tool holder is guided in a vertical guide and the vertical guide can be adjusted by a half mesh-length in the transverse direction.

12. A method for producing expanded metal, the method comprising the steps of:

a) a flat material is guided between a stationary knife and an adjustable knife in a direction of transport;

b) a cutting edge of the adjustable knife includes cutting projections and cuts into the material in a vertical direction, the vertical direction being perpendicular to the direction of transport, and webs being formed in this manner in a stretching expansion manner;

c) the adjustable knife is guided back out of the material in the vertical direction;

d) the adjustable knife is adjusted by a half mesh-length in a transverse direction, the transverse direction being transverse to the vertical direction, and the vertical direction and the transverse direction determining a plane;

e) the adjustable knife cuts into the material in the vertical direction while the webs are subjected to stretch expansion forming;

f) the adjustable knife is guided back out of the material in the vertical direction;

g) the adjustable knife is guided back in the transverse direction by the half mesh-length;

h) the adjustable knife is adjusted in the vertical direction by a cam; and i) the cam is driven by at least one eccentric and the cam executes a circulatory motion which runs the plane determined by the vertical direction and the transverse direction.

13. The method according to claim 12, wherein:

a) the cam is driven by at least two coupled eccentrics.

14. The method according to claim 13, wherein:

a) the cam is prestressed in the direction opposite to the working motion.

15. The method according to claim 12, wherein:

a) shafts are provided, and the shafts drive the eccentrics, and the shafts are tensioned by a belt.

16. The method according to claim 15, wherein:

a) the shafts driving the cam are driven with a variable rotational speed, whereby a driving motion, in which the adjustable knife cuts into the material, is executed more slowly than an immediately subsequent idle movement.

17. The method according to claim 12, wherein:

a) the adjustable knife is accommodated in a tool holder, which is adjusted in the transverse direction by the transverse adjusting device, and in the vertical direction by the cam; and b) the tool holder is accommodated on the cam in an adjustable manner in the transverse direction and executes a purely vertical traveling motion.

18. The method according to claim 17, wherein:

a) the tool holder is guided in a vertical guide and the vertical guide is adjusted in the transverse direction by the half mesh-length.

* * * * *